US008720994B2

(12) United States Patent
Gorgi

(10) Patent No.: US 8,720,994 B2
(45) Date of Patent: May 13, 2014

(54) SYSTEM FOR ADJUSTING THE RELATIVE POSITION BETWEEN TWO FURNITURE PARTS

(75) Inventor: Claudio Gorgi, Rossano Veneto (IT)

(73) Assignee: IMARC S.p.A., Rossano Veneto (VI) (IT)

( * ) Notice: Subject to any disclaimer, the term of this patent is extended or adjusted under 35 U.S.C. 154(b) by 213 days.

(21) Appl. No.: 13/121,003

(22) PCT Filed: Oct. 19, 2009

(86) PCT No.: PCT/EP2009/063647

§ 371 (c)(1), (2), (4) Date: Mar. 25, 2011

(87) PCT Pub. No.: WO2010/046334

PCT Pub. Date: Apr. 29, 2010

(65) Prior Publication Data

US 2011/0193385 A1 Aug. 11, 2011

(30) Foreign Application Priority Data

Oct. 22, 2008 (IT) ..... VE2008A0079

(51) Int. Cl.
*A47C 31/00* (2006.01)

(52) U.S. Cl.
USPC ..... 297/313; 297/463.1

(58) Field of Classification Search
USPC ..... 297/313, 337, 463.1; 74/54
See application file for complete search history.

(56) References Cited

U.S. PATENT DOCUMENTS

| | | | | |
|---|---|---|---|---|
| 6,840,578 | B1 | 1/2005 | Su | |
| 7,503,626 | B2 * | 3/2009 | Maier et al. | 297/300.2 |
| 2005/0280301 | A1 * | 12/2005 | Freed et al. | 297/337 |
| 2008/0054700 | A1 * | 3/2008 | Meidan | 297/361.1 |
| 2008/0093904 | A1 * | 4/2008 | Maier | 297/313 |
| 2008/0174161 | A1 * | 7/2008 | Maier et al. | 297/301.4 |
| 2010/0194161 | A1 * | 8/2010 | Costaglia | 297/313 |

FOREIGN PATENT DOCUMENTS

| | | |
|---|---|---|
| EP | 1332696 | 5/2006 |
| EP | 1719435 | 11/2006 |
| FR | 2277551 | 2/1976 |
| WO | 2008119010 | 10/2008 |

* cited by examiner

*Primary Examiner* — Philip Gabler
(74) *Attorney, Agent, or Firm* — Themis Law

(57) ABSTRACT

A system for adjusting the relative position between two furniture parts includes a first part provided on one side with at least two parallel guide surfaces at a prefixed distance X apart, a second part facing the first part, an eccentric multi-lobe cam, the continuous profile of which is composed of tangential curves disposed such as to form an odd number n of pairs of opposing arcs, each pair of arcs having the same center of curvature with the sum of the radii of curvature being equal to X, the cam being housed between said two parallel guides and being pivoted to said second part on the eccentric pin, and means for rotating the multi-lobe cam.

9 Claims, 4 Drawing Sheets

SYSTEM FOR ADJUSTING THE RELATIVE POSITION BETWEEN TWO FURNITURE PARTS

FIELD OF THE INVENTION

The present invention relates to a system for adjusting the relative position between two furniture parts.

The invention relates in particular to a system for adjusting the inclination of the seating portion in relation to the back rest in a chair.

BACKGROUND OF THE INVENTION

Chairs of this type are important both in the office sector, in which a user can ergonomically adapt the chair to the personally preferred working position, and in the private sector in that it enables the relative position between the seating portion and back rest to be modified to make it more comfortable for relaxing.

Chairs are already known comprising an inclinable seating portion and back rest which can vary their inclination to the rest of the chair by synchronous mutual rotation at a fixed ratio, by which the angle between one part and the other is varied.

These chairs have had great success but have however proved to be susceptible to improvement with regard to the ability to change the initial angle between the seating portion and back rest, which is predetermined by the synchronism ratio of the mechanism itself. It follows that given a particular back rest inclination, the user is unable to independently modify the inclination of the seating portion or vice versa, because one part fixes the other.

To avoid this drawback, a series of devices have been proposed which are able to adjust the inclination of just one of the two components while leaving the other fixed.

In particular, EP 1192876 and EP 1946674 describe an inclination adjustment device consisting of a cam which when rotated by a lever displaces the height of one of the two chair fixing points, for example the rear point, to hence modify the chair inclination.

The drawback of this system is that only two stable positions are possible, namely the starting position and that reached after the adjustment.

Continuous adjustment solutions are also known which allow adjustment of opposing surfaces of two facing elements along a plurality of substantially stable positions.

U.S. Pat. No. 6,039,338 relates to an inclined surface device which on rotation about its rotational axis thrusts against the contact surface of the opposing element. By suitably shaping the two contact surfaces, the inclination of one element to the other can be modified.

WO2007/083186 relates to a device for adjusting the rotation of at least one movable element of the chair. Although it enables the position of the opposing surfaces to be adjusted, this element has the drawback of being unidirectional so that pulling systems have to be used to maintain the opposing elements in mutual contact. The result is a bulky and costly construction which always requires the presence of additional locking means to prevent movement reversibility.

SUMMARY OF THE INVENTION

An object of the invention is to eliminate these drawbacks by providing a compact adjustment system enabling a prechosen number of stable positions to be attained, which determine different distances between two mutually connected elements.

This and other objects which will be apparent from the ensuing description are attained according to the invention by a system for adjusting the relative position between two furniture parts as described hereinbelow.

BRIEF DESCRIPTION OF THE DRAWINGS

A preferred embodiment and some variants of the present invention are further clarified hereinafter with reference to the accompanying drawings, in which.

DETAILED DESCRIPTION OF EMBODIMENTS OF THE INVENTION

Figure 1:
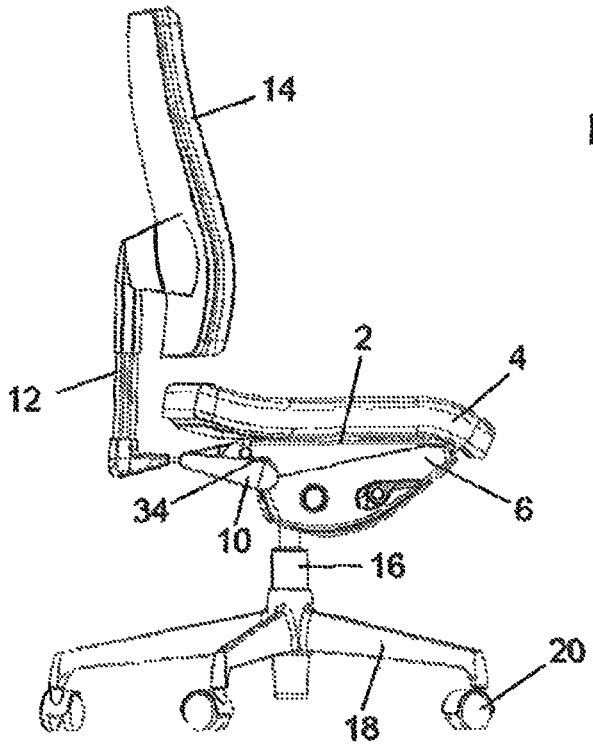
FIG. 1 is a side view of a chair shown with the seating portion in its minimum inclination position, provided with an adjustment system according to the invention.
Figure 2:
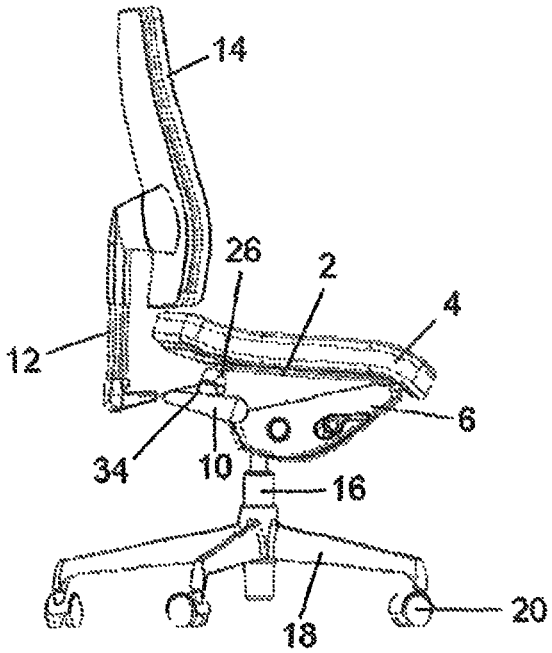
FIG. 2 shows the chair in the view of FIG. 1 but with the seating portion in its maximum inclination position.
Figure 3:
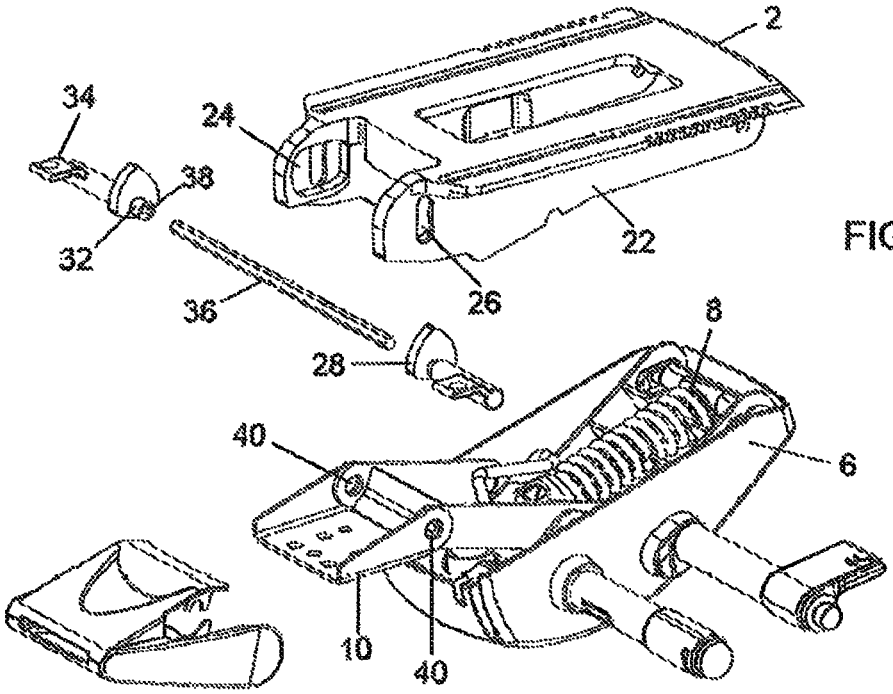
FIG. 3 is an exploded view showing the seat plate, the back rest support, the rotation mechanism and the adjustment system of the invention.
Figure 4:
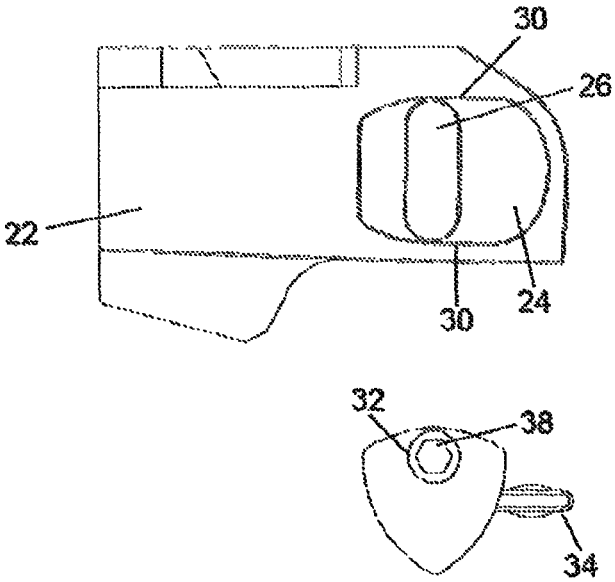
FIG. 4 is a side view of an adjustment system according to the invention.

As it can be seen from the figures, an adjustment system according to the invention is applied to a traditional office chair consisting of a plate 2 supporting the seating portion 4 and hinged to a box structure 6 housing a rotary device 8.

The box structure 6 is also hinged at its rear to an elongated plate 10 to which the bracket 12 of the back rest 14 is fixed.

The box structure 6 is supported by a height-adjustable column 16 provided lowerly with radial bars 18 having wheels 20.

The lower surface of the plate 2 is provided with two shoulders 22, each of which is provided in its front part with a quadrangular cavity 24 comprising a vertically slotted hole 26.

Said cavity houses two three-lobe blocks 28 shaped substantially as an equilateral triangle with curved sides and having a height substantially corresponding to the distance X between the two horizontal parallel edges 30 bounding the cavity 24.

The three-lobe blocks 28 are provided on one side with a cylindrical eccentric collar 32 engaged in the slotted hole 26, and on the other side with an adjustment knob 34.

The two three-lobe blocks are mutually constrained rotoidally by a hexagonal bar 36 inserted into a corresponding internal hexagonal seat 38 in the collar 32, said bar also passing through two coaxial holes 40 provided in the plate 10.

In this manner a structure is obtained consisting of a plate 2 hinged at its front to the box structure 6 and at its rear to the bracket 10 supporting the back rest 12, itself hinged to the box structure.

The adjustment system operates in the following manner:

with the seating portion at its minimum inclination (see FIG. 5*a*) the three-lobe block 28 is positioned with its upper curved side in contact with the upper edge 30 of the cavity 24 and the opposite vertex in contact with the lower edge 30 of the cavity. When in this condition, the cylindrical collars 32 are disposed in the upper position of the slotted holes 26.

Figure 5:
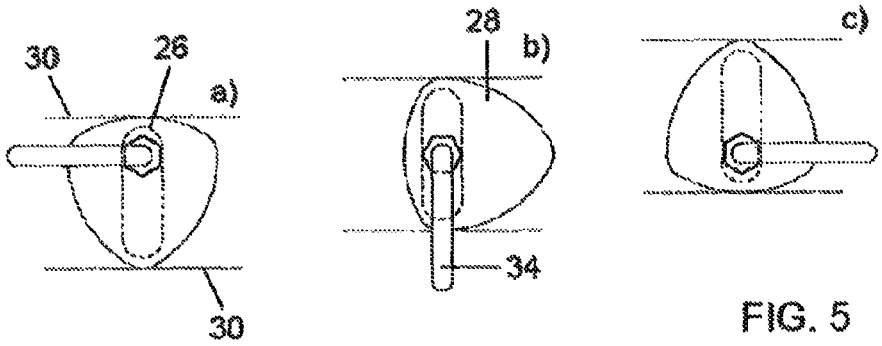
FIGS. 5*a*-5*c* show in schematic view the stable equilibrium positions attained by an adjustment system according to the invention.

By rotating the knob 34 the three-lobe block, locked within the cavity, rotates into the configuration shown in FIG. 5*b*, which shows it in contact with the cavity edges 30 at one of the vertices in order, by virtue of the eccentric presence of the collars guided within the hole 26, to raise the shoulder 22 and hence the seat plate 2 relative to the box structure 6.

On continuing to rotate the lever, the three-lobe block moves into the configuration shown in FIG. 5*c*, in which it rests with a curved side on the lower edge of the seat and with the vertex on the opposite upper parallel side, with consequent further raising of the shoulder 22.

It should be noted that all the achieved positions are stable in that in all these cases the cylindrical collars 32 move into alignment with the contact points between the three-lobe block 28 and the cavity edges 30, to which this direction is perpendicular. This direction corresponds to that, along which the force due to the user's weight on the seating portion is transferred: consequently under all utilized conditions the load is transmitted from the edges directly onto the collars 32 and then to the cylindrical seats of the back rest support without any instability developing from peripheral thrusts able to rotate the three-lobe block.

When one of the stable positions is chosen, the relative angle between the back rest and seating portion is also established, then on using the chair in the traditional manner, i.e. by swinging forwards and rearwards in accordance with the synchronism established by the mechanism, the prechosen position will be achieved on each return.

Figure 6:
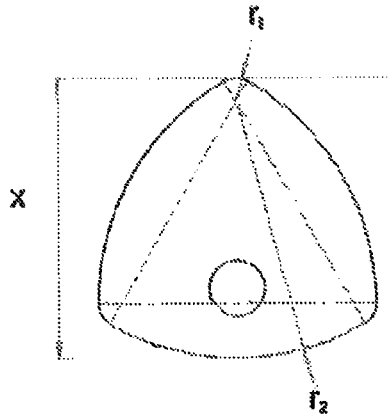
FIG. 6 shows a three-lobe cam with its construction lines.

In order for the three-lobe cam to be in contact with the edges 30 located at a distance X from each other, it consists, as shown in FIG. 6, of arcs connected together such that opposing arcs tangential to the upper and lower surfaces 30 are concentric and the sum of their radii $r_1$ and $r_2$ is equal to the distance X. In this manner, for any rotation of the cam it is always tangential to the edges 30 of the seat 24. A certain number of stable positions and a certain eccentricity value are achieved depending on the position at which the eccentric fulcrum is chosen.

Figure 7:
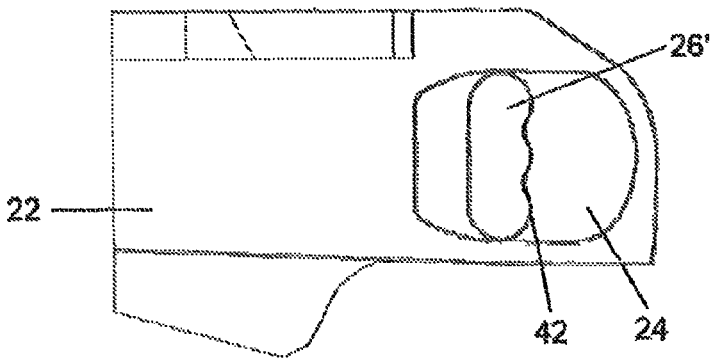
FIG. 7 is a side view of a variant of the system.

To ensure greater stability of the cam rotation positions and to verify that the rotation has reached the correct position for alignment between the hexagonal seat 38 and the tangency points between the cam 38 and surface 30, the variant shown in FIG. 7 has the side walls of the slotted hole 26' provided with a plurality of notches 42.

In a further variant (not shown in the drawings) the notches are provided on the walls 30 or 46 of the pocket 24.

Figure 8:
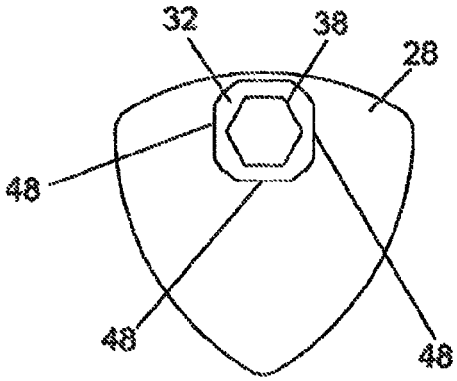
FIG. 8 shows the profile of a variant of the cam.

In the embodiment shown in FIG. 8, to achieve greater stability of the cam positions, the cylindrical collar 32 is faceted to provide surfaces 48 in contact with the straight edge of the slot 26. In all cases the stable positions are achieved by deformation of the materials or by virtue of the mechanism geometry.

Figure 9:
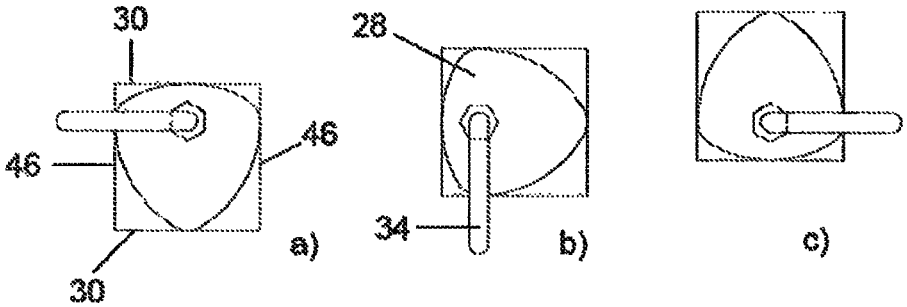
FIGS. 9*a*-9*c* show a variant of the cam during its use.

In the embodiment shown in FIGS. 9*a*-9*c* a square seat 24 is shown. The vertical guide in this case consists of the vertical walls 46 of the seat 24 which are parallel to each other at a distance X apart. On rotating the knob 34, this embodiment enables the cylindrical collar and hence the seating portion to be both raised and displaced relative to the box structure.

Figure 10:
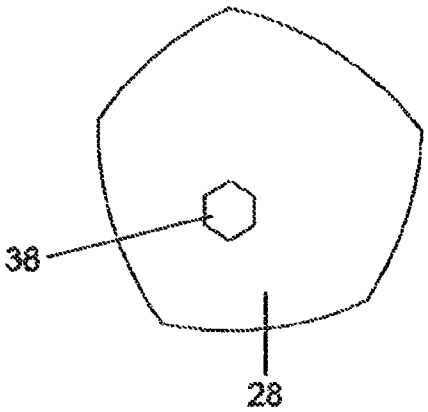
FIG. 10 shows the profile of a multi-lobe variant of the cam.

FIG. 10 shows a further possible embodiment of the multi-lobe block, enabling more stable positions of the plate to be achieved relative to the box structure.

The invention claimed is:

1. A system for adjusting a relative position between two furniture parts comprising:

a first part having a first side and a second side, at least two parallel guide surfaces spaced apart for a distance X being defined on the first side;

a second part facing said first part;

a multi-lobe cam having a continuous profile consisting of a plurality of curved portions forming an odd number n of pairs of first and second arcs, wherein $n \geq 3$, wherein a first arc of each pair has a concavity faced toward a concavity of a second arc of the same pair, said first and said second arc having a same center of curvature, wherein a sum of a radius of curvature $r_1$ of the first arc of each pair and of a radius of curvature $r_2$ of the second arc of the same pair are equal to the distance X, and wherein the multi-lobe cam is housed within two of the at least two parallel guide surfaces, such to engage said two of the at least two parallel guide surfaces, and is pivoted to the second part to rotate eccentrically, thereby causing the two furniture parts to be in at least three stable positions in relation to each other; and a member configured to rotate the multi-lobe cam.

2. The system of claim 1, wherein all of the first arcs of each pair of arcs have a same radius of curvature.

3. The system of claim 1, wherein the parallel guide surfaces are provided on a seat defined on said first side of said first part, the multi-lobe cam being housed within said seat.

4. The system of claim 3, wherein the seat defines a first and a second pair of parallel guide surfaces, said first pair being disposed perpendicularly to said second pair.

5. The system of claim 4, wherein the guide surfaces present a plurality of notches.

6. The system of claim 3, wherein the multi-lobe cam is provided with a collar extending from said multi-lobe cam, said collar engaging a vertical holed slot provided in the first part, said vertical holed slot extending from said first side to said second side and crossing through said seat.

7. The system of claim 6, wherein side walls of the slot are provided with a plurality of notches.

8. The system of claim 6, wherein the collar has a faceted lateral surface.

9. The system of claim 3, wherein the first part comprises a support for a seating portion of a chair, wherein said multi-lobe cam is a plurality of multi-lobe cams, and said seat is a plurality of seats housing the plurality of multi-lobe cams, said plurality of seats each having horizontal edges positioned apart at the distance X, wherein the second part comprises a support structure for a back rest, the plurality of multi-lobe cams being rotatably constrained to each other by a bar which also engages holes provided in the support structure for the back rest.

* * * * *